US010358863B2

(12) United States Patent
Ripoche et al.

(10) Patent No.: US 10,358,863 B2
(45) Date of Patent: Jul. 23, 2019

(54) PROCESS FOR MANUFACTURING A GAS-FILLED MULTIPLE GLAZING UNIT

(71) Applicant: SAINT-GOBAIN GLASS FRANCE, Courbevoie (FR)

(72) Inventors: Xavier Ripoche, Roiffieux (FR); Sebastien Hervieux, Choisy au Bac (FR); Aliou Diop, Margny les Complegne (FR); Laurent Lagneaux, Larbroye (FR)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 1192 days.

(21) Appl. No.: 14/365,401

(22) PCT Filed: Dec. 10, 2012

(86) PCT No.: PCT/FR2012/052858

§ 371 (c)(1),
(2) Date: Jun. 13, 2014

(87) PCT Pub. No.: WO2013/088044

PCT Pub. Date: Jun. 20, 2013

(65) Prior Publication Data

US 2014/0345781 A1 Nov. 27, 2014

(30) Foreign Application Priority Data

Dec. 15, 2011 (FR) ..... 11 61688

(51) Int. Cl.
*E06B 3/673* (2006.01)
*E06B 3/667* (2006.01)
*E06B 3/677* (2006.01)

(52) U.S. Cl.
CPC ..... *E06B 3/673* (2013.01); *E06B 3/6675* (2013.01); *E06B 3/6775* (2013.01)

(58) Field of Classification Search
CPC ..... E06B 3/6775; E06B 3/673
(Continued)

(56) References Cited

U.S. PATENT DOCUMENTS 5,350,469 A * 9/1994 Lenhardt ..... E06B 3/6775 156/102
5,645,678 A * 7/1997 Lisec ..... E06B 3/6775 141/59

(Continued)

FOREIGN PATENT DOCUMENTS

AT 368 985 B 11/1982
AT 399 499 B 5/1995

(Continued)

OTHER PUBLICATIONS

International Search Report issued for International Application No. PCT/FR2012/052858, dated Jun. 14, 2013.

*Primary Examiner* — Philip C Tucker
*Assistant Examiner* — John Blades
(74) *Attorney, Agent, or Firm* — Pillsbury Winthrop Shaw Pittman LLP

(57) ABSTRACT

A process for manufacturing a gas-filled multiple glazing unit including at least two glass sheets, the process including a preassembly step in which each glass sheet is positioned inclined at an angle strictly greater than 0° and less than or equal to 10° to the adjacent glass sheet, so as to form at least one cavity, each cavity being completely closed on one of its sides; a step of partially blocking at least one of the sides of each cavity; a step of filling each cavity with gas via an injection side of the cavity; and a step of pressing the glass sheets. One or more cavities of a multiple glazing unit can be filled while reducing the amount of gas used and the filling times.

23 Claims, 2 Drawing Sheets

(58) Field of Classification Search
USPC ..... 156/109
See application file for complete search history.

(56) References Cited

U.S. PATENT DOCUMENTS

| | | | | |
|---|---|---|---|---|
| 5,762,739 | A * | 6/1998 | Lenhardt | E06B 3/6775 156/107 |
| 5,957,169 | A * | 9/1999 | Trpkovski | E06B 3/6775 141/129 |
| 6,158,483 | A | 12/2000 | Trpkovski | |
| 2007/0068616 | A1 * | 3/2007 | Schuler | E06B 3/67386 156/109 |
| 2011/0154635 | A1 * | 6/2011 | Wunnicke | E06B 3/67386 29/428 |

FOREIGN PATENT DOCUMENTS

| | | | |
|---|---|---|---|
| EP | 0 276 647 | B1 | 9/1990 |
| EP | 0 674 085 | A1 | 9/1995 |
| WO | WO 2011/095732 | | 8/2011 |
| WO | WO 2013/088044 | A2 | 6/2013 |

* cited by examiner

PROCESS FOR MANUFACTURING A GAS-FILLED MULTIPLE GLAZING UNIT

CROSS-REFERENCE TO RELATED APPLICATIONS

This application is the U.S. National Stage of PCT/FR2012/052858, filed Dec. 10, 2012, which in turn claims priority to French Application No. 1161688, filed Dec. 15, 2011. The content of both applications are incorporated herein by reference in their entirety.

The invention relates to a process for manufacturing a multiple glazing unit comprising at least two glass sheets, each cavity of which, located between two adjacent glass sheets, is filled with gas. The invention more particularly relates to the step of filling the cavities by injecting a gas.

A multiple glazing unit comprises at least two glass sheets spaced apart pairwise by a spacer bar so as to form a cavity between two adjacent glass sheets.

Various technologies for filling the one or more cavities of a multiple glazing unit with gas are known.

In particular, it is known to place the glass sheets parallel to one another, with a space between them greater than the thickness of the spacer bar, and then to inject the gas via the lower side of the cavity. Air is then evacuated via the three other sides. However this technology requires the use of a large amount of gas and long filling times. It is also known to improve the efficiency of this technology, in terms of gas used, by completely blocking the vertical edges. The air then escapes via the upper side of the cavity.

It is also known to place the glass sheets parallel to one another, spaced apart pairwise only by the thickness of the spacer bar, and to move apart the edges of the glass sheets on one side of the glazing unit by applying a tensile strain, so as to create an aperture in the cavity. Gas is then injected into the cavity via this aperture. However, this technology is complicated and involves a long filling time, in particular for large glazing units.

It is also known to fan out the glass sheets, i.e. to incline them relative to one another, supported by the upper part of one of them, and to introduce the glass sheets thus arranged into a chamber and to fill this chamber with gas. However, this technology requires the use of a large amount of gas and long filling times.

There is therefore a need for an assembly line process for manufacturing a multiple glazing unit that allows the one or more cavities of a multiple glazing unit to be filled while reducing the amount of gas used and the filling times.

For this purpose, the invention provides a process for manufacturing a gas-filled multiple glazing unit comprising at least two glass sheets, the process comprising:

- a preassembly step in which the glass sheets are positioned facing one another, at least one of the glass sheets being equipped with a spacer and each glass sheet being positioned inclined at an angle strictly greater than 0° and less than or equal to 10° to the adjacent glass sheet, so as to form at least one cavity, each cavity being located between two adjacent glass sheets and being completely closed on one of its sides;
- a step of partially blocking at least one of the sides of each cavity;
- a step of filling each cavity by injecting gas via an injection side of the cavity; and
- a step of pressing the glass sheets against one another in order to seal the multiple glazing unit.

According to another feature, the one or more partially blocked sides are blocked over at least 3% of their length and over at most 90% of their length.

According to another feature, the one or more partially blocked sides are blocked over a portion starting from one of their ends.

According to another feature, the gas is injected over at least one portion of the length of the injection side of each cavity.

According to another feature, the gas injection portion is between 10 and 100%, preferably between 30 and 50%, or even a third of the length of the injection side of each cavity.

According to another feature, two sides are partially blocked and the gas injection portion is located in the center of the injection side of each cavity, the gas injection portion remaining constant throughout the filling step, and preferably being a third of the length of the injection side of each cavity.

According to another feature, one side is partially blocked, and another side is completely blocked.

According to another feature, the gas injection portion is located near the corner formed between the completely blocked side and the injection side, the gas injection portion gradually increasing during the filling step, preferably up to 100% of the length of the injection side of each cavity.

According to another feature, the process furthermore comprises, in the filling step, a step of measuring the gas fill level of each cavity using a sensor located on the one or more partially blocked sides.

According to another feature, the flow rate of gas injected into a cavity is proportional to the height of the glazing unit and the thickness of the cavity.

According to another feature, when the glazing unit comprises at least three glass sheets, the various cavities are all filled with gas at the same time.

According to another feature, in the filling step the gas injected is a heavy gas.

According to another feature, in the filling step the gas is injected into the cavities via orifices provided in a belt for conveying the glass sheets.

According to another feature, the filling step comprises a prior step in which the cavities are evacuated, before the gas is injected.

Other features and advantages of the invention will now be described with regard to the drawings, in which.

Figure 1:
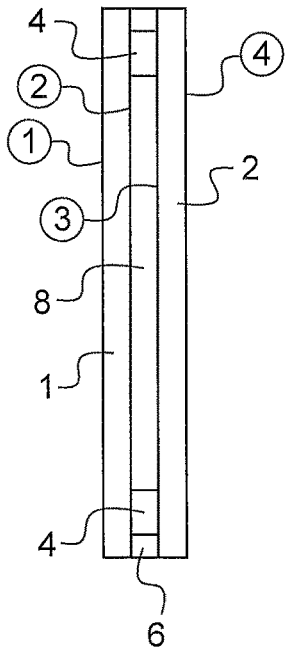
FIG. 1 shows a cross-sectional view of a double glazing unit.

Reference numbers that are identical in the various figures represent similar or identical elements. FIGS. 5 and 6*a* to 6*c* show front views just as well for the embodiment in FIG. 3 as for the embodiment in FIG. 4.

Throughout the description, the expression "glass sheet" will be understood to mean a "substrate with a glazing function", the substrate possibly being an organic or mineral substrate.

The invention relates to an assembly line process for manufacturing a gas-filled multiple glazing unit comprising at least two glass sheets. The process comprises a preassembly step in which the glass sheets are positioned facing one another, at least one of the glass sheets being equipped with a spacer, and each glass sheet being positioned inclined at an angle strictly greater than 0° and less than or equal to 10° to the adjacent glass sheet, so as to form at least one cavity. Each cavity is located between two adjacent glass sheets and is completely closed on one of its sides.

The process also comprises a step of partially blocking at least one of the sides of each cavity.

the process also comprises a step of filling each cavity by injecting gas via an injection side of the cavity.

the process also comprises a step of pressing the glass sheets against one another in order to seal the multiple glazing unit.

Thus, by virtue of the partial blocking of at least one of the sides of each cavity, the injected gas, once it has pushed the air out of the cavity, is better confined inside the cavity, thereby allowing less gas to be lost and therefore the amount of gas used and the filling times to be reduced.

The process according to the invention allows multiple glazing units (double glazing units, triple glazing units, quadruple glazing units, etc.) to be obtained. It is conventional to number the various faces of the glass sheets of a multiple glazing unit starting from ①, the number ① denoting the external face of the glass sheet intended to be turned toward the exterior of a building. Thus, for a double glazing unit (FIG. 1), the external face of the glass sheet 1 intended to be turned toward the exterior of a building is numbered ①, the internal face of the glass sheet 1 intended to be turned toward the exterior of a building is numbered ②, the external face of the glass sheet 2 intended to be turned toward the interior of a building is numbered ③, and the internal face of the glass sheet 2 intended to be turned toward the interior of a building is numbered ④. Likewise, for a triple glazing unit (FIG. 2), the external face of the external glass sheet 1 intended to be turned toward the exterior of a building is numbered ①, the internal face of the external glass sheet 1 intended to be turned toward the exterior of a building is numbered ②, the face of the internal glass sheet 2 turned toward the external glass sheet 1 is numbered ③, the face of the internal glass sheet 2 turned toward the external glass sheet 3 is numbered ④, the internal face of the external glass sheet 3 intended to be turned toward the interior of a building is numbered ⑤, and the external face of the external glass sheet 3 intended to be turned toward the interior of a building is numbered ⑥.

FIG. 1 shows a cross-sectional view of a double glazing unit obtained using the process according to the invention.

A double glazing unit comprises two glass sheets 1, 2 placed parallel to and facing each other.

The two glass sheets may have different thicknesses. The dimensions (area, thicknesses of the glass sheets) are chosen depending on the intended application of the double glazing unit.

The double glazing unit also comprises a spacer 4, taking the form of a framework, used to keep the glass sheets a distance apart from each other so as to form a gas-containing cavity 8 or gas gap. This gas-filled cavity 8 provides the double glazing unit with good thermal and acoustic insulating properties. The spacer 4 is located between the two faces ② and ③, located facing each other, of the two glass sheets, near the edge of the glass sheets, namely between the two glass sheets 1, 2.

The double glazing unit also comprises, for a good seal, a mastic bead 6 located between the external face of the spacer 4 and the edge of the glass sheets 1, 2.

Figure 2:
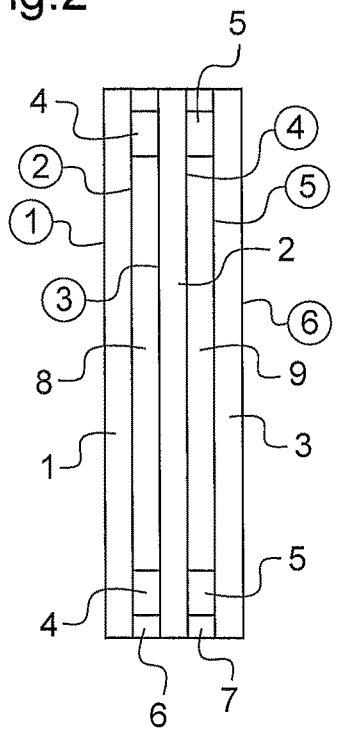
FIG. 2 shows a cross-sectional view of a triple glazing unit.

FIG. 2 shows a cross-sectional view of a triple glazing unit obtained using the process according to the invention.

A triple glazing unit comprises three glass sheets 1, 2, 3 placed parallel to and facing one another. One of the glass sheets, called the internal glass sheet 2, is located between the two other glass sheets, called external glass sheets 1, 3.

The three glass sheets may have the same area, as in FIG. 2, or have different areas, the internal glass sheet 2 for example having a smaller area than that of the external glass sheets 1, 3. The three glass sheets 1, 2, 3 may also have different thicknesses. The dimensions (area, thicknesses of the glass sheets) are chosen depending on the intended application of the triple glazing unit.

The triple glazing unit also comprises two spacers 4, 5, each taking the form of a framework, used to keep the glass sheets a distance apart from one another so as to form two gas-containing cavities 8, 9 or gas gaps. These gas-filled cavities 8, 9 provide the triple glazing unit with good thermal and acoustic insulating properties. The two cavities 8, 9 may have the same thickness or have different thicknesses, depending on the intended application of the triple glazing unit. Each spacer 4, 5 is located between two faces, located facing each other, of two adjacent glass sheets, near the edge of the glass sheets. Each spacer 4, 5 is therefore located between faces ② and ③, on the one hand, and faces ④ and ⑤, on the other hand, namely between the internal glass sheet 2 and one of the two external glass sheets 1, 3.

As a variant (not shown), the internal glass sheet may be smaller than the external glass sheets. The triple glazing unit then preferably comprises a single spacer that is placed between the two external glass sheets, and the spacer comprises a groove in its internal face, into which the edge of the internal glass sheet is inserted.

The triple glazing unit also comprises, for a good seal, a mastic bead 6, 7 located between the external face of the spacers 4, 5 and the edge of the glass sheets 1, 2, 3.

The process for manufacturing a gas-filled multiple glazing unit according to the invention comprises four main steps: a preassembly step, a step of partially blocking the cavities, a step of filling the cavities by injecting gas and of brief pressing and a pressing step.

Preferably, for reasons of throughput, the preassembly step is carried out in a first work station (or in two first work stations), the step of partially blocking the cavities and the step of filling the cavities by injecting gas and of brief pressing are carried out in a second work station, and the pressing step is carried out in a third work station. Since the manufacturing steps are split between a number of stations, several multiple glazing units can be manufactured simultaneously. In the case of a multiple glazing unit comprising at least three glass sheets, these sheets are processed at the same time in order to produce a triple glazing unit, thereby saving a lot of time relative to a process in which a double glazing is manufactured first, then a triple glazing from the double glazing, etc.

Figure 3:
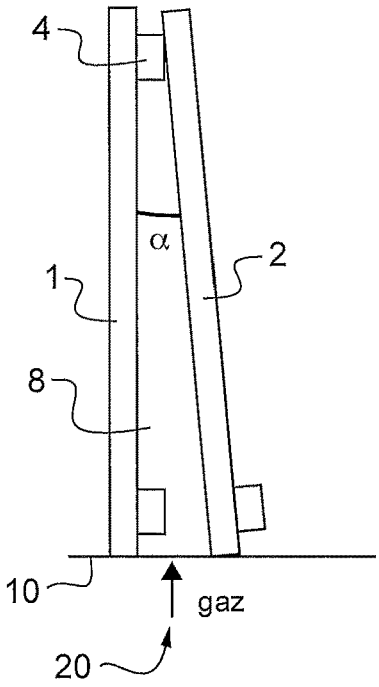
FIGS. 3 and 4 show a cross-sectional view of the filling step for a double glazing unit and a triple glazing unit, respectively.
Figure 4:
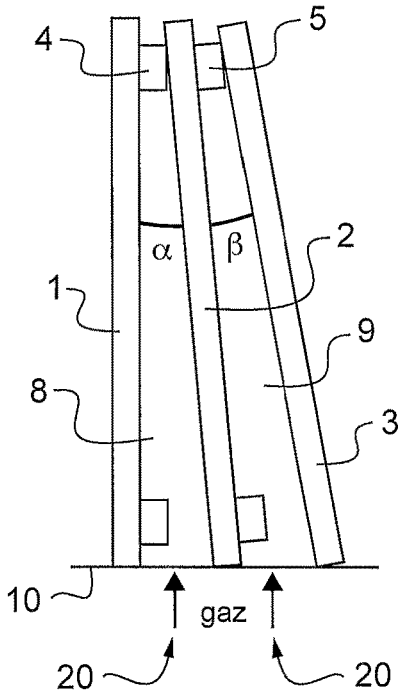

In the preassembly step, the glass sheets are fanned out. FIGS. 3 and 4 show glass sheets 1, 2 and 1, 2, 3, respectively once they have been fanned out on a conveyor belt 10. The glass sheets 1, 2 and 1, 2, 3, respectively, are conveyed one after the other and positioned next to one another on the conveyer belt 10, preferably by the first work station(s). The conveyor belt 10 allows the glass sheets to be conveyed from the first work station(s) to the second work station, and then to the third work station when the various steps of the process are carried out in different work stations.

Figure 5:
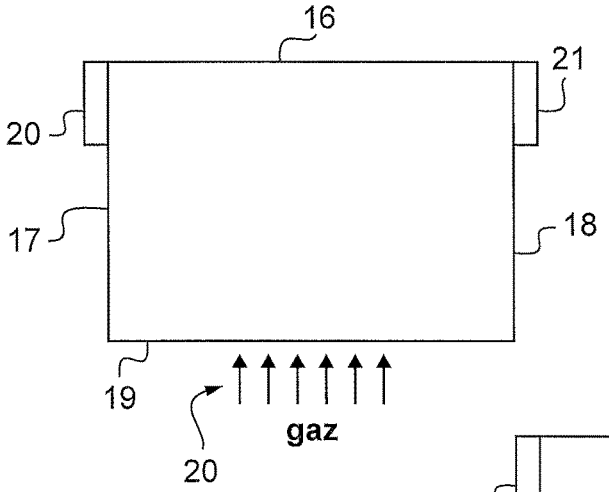
FIG. 5 shows a front view of the filling step according to one embodiment in which two removable blocking means partially close two edges of each cavity.

Each glass sheet 1, 2 and 1, 2, 3, respectively, is positioned inclined at an angle α and α, β, respectively, strictly greater than 0° and less than or equal to 10° to the adjacent glass sheet. The glass sheets are said to be "fanned out" in this configuration. At least one of the glass sheets comprises a spacer 4, 5. Each cavity 8, 9 is defined by a spacer 4, 5 and by two adjacent glass sheets 1, 2 and 1, 2 or 2, 3, respectively. Since the angle of inclination between two adjacent glass sheets is nonzero, the multiple glazing unit can be completely closed in the fanned out position on one of its four sides, called the completely closed side 16 (FIG. 5). The three other sides 17, 18, 19 (FIG. 5) of the one or more cavities 8, 9 are completely open at the end of the preassembly step. In the figures, the completely closed side 16 of each cavity 8, 9 is horizontal and located at the top of the glazing unit, and gas is injected via the injection side 19, which is also horizontal and located at the bottom of the glazing unit. The two other sides 17, 18 are vertical in the figures. This should not be understood as a limitation. Specifically, the completely closed side could be at an angle of 90° to the conveyor belt, or even on the conveyor belt.

The preassembly step will be described in greater detail later on in the description.

After the preassembly step, once the glass sheets 1, 2 and 1, 2, 3, respectively, have been placed in position on the conveyor belt 10, comes the step of partially blocking the cavity or cavities. If this step is carried out in a second work station, the conveyor belt 10 may be activated in order to move the fanned out glass sheets as far as the second work station.

FIGS. 5 and 6*a* to 6*c* show a front view of the filling step according to two embodiments. In these figures, the references 16 to 19 designate the sides of each cavity 8, 9. In particular, the reference 16 designates the side that is completely closed during the preassembly step—in the figures, the side 16 is at the top of the glazing unit. Reference 19 designates the side via which the gas will be injected. This side is called the injection side 19. In the figures, the injection side 19 is at the bottom of the glazing unit, near the conveyor belt 10. The sides 17 and 18 connect the completely closed side 16 and the injection side 19. After the preassembly step, only the side 16 is completely closed, and the sides 17 to 19 are completely open. As a variant, the injection side 19 may be adjacent the completely closed side 16.

During the step of partially blocking the cavity or cavities, at least one of the sides 17, 18 of each cavity 8, 9 is partially blocked by removable blocking means 20, 21, 22. Thus, preferably, one of the sides is partially blocked by removable blocking means, another side is partially blocked, or completely blocked, by removable blocking means, one side is completely closed by the glass sheets placed against the spacer or spacers, and one side is used for the gas injection. The gas injection side may be partially blocked, for example by a strip equipped with holes allowing the gas to be injected. In this way, the gas subsequently injected during the filling step pushes the air contained inside the cavity or cavities 8, 9 out of the glazing unit and the injected gas is more easily contained in the cavity or cavities, by virtue of this partial blocking. In particular, partially blocking at least one side means that the gas flow in the cavity is different to that produced in a cavity with three completely unblocked sides or two completely unblocked sides or even a single completely unblocked side. This gas flow makes it easier to remove the air and keep the gas in the cavity, thereby allowing less gas to be used. In the figures, the partially or completely blocked side or sides 17, 18 are adjacent the completely closed side 16 of the cavity.

Preferably, the partially blocked side or sides 17, 18 are blocked over at least 3% of their length and over at most 90% of their length in order to decrease the amount of gas used and the gas filling time, preferably between 7% and 50% of their length for even better performance, even about 14% of their length for the best compromise between gas filling speed and gas loss. Whatever the size of the glazing unit, the blocked length is preferably at least 5 cm in order for the partial blocking to have an impact on the amount of gas used and the gas filling time.

Preferably, the partially blocked side or sides 17, 18 are blocked over a portion starting from one of their ends. In the figures, the partially blocked side or sides 17, 18 are blocked over a portion starting from the corner formed with the completely closed side 16, in order to optimize the gas filling speed. As a variant, the partially blocked side or sides 17, 18 are blocked over a portion starting from the corner formed with the injection side 19 or even do not start from a corner but are positioned somewhere between the two corners.

In the embodiment in FIG. 5, the two sides 17 and 18 are partially blocked by removable blocking means 20, 21. These removable blocking means 20, 21 preferably block the same height on both sides 17, 18. As a variant, the removable blocking means 20, 21 block different heights on both sides 17, 18.

Figure 6A:
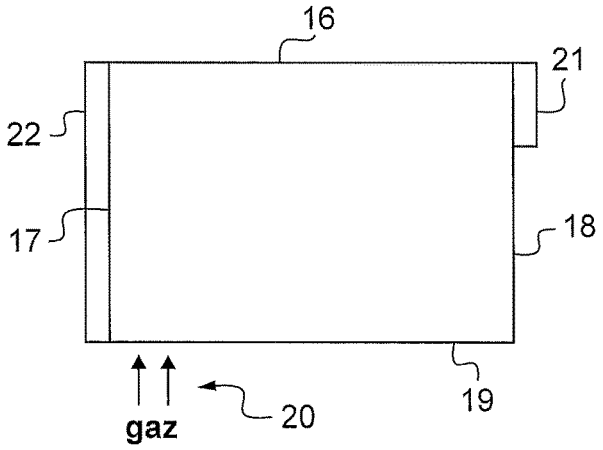
FIGS. 6*a* to 6*c* show a front view of the filling step according to one embodiment in which two removable blocking means each close, one partially, the other completely, one edge of each cavity.
Figure 6B:
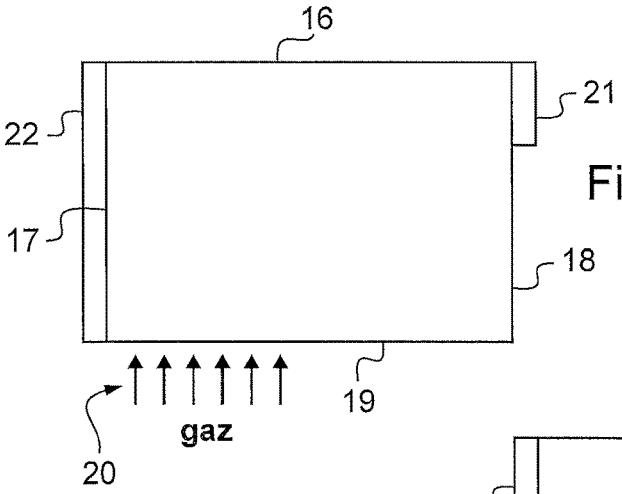
Figure 6C:
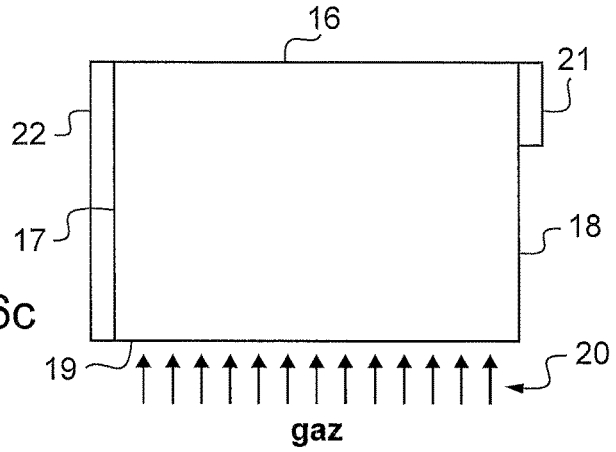

In the embodiment in FIGS. 6*a* to 6*c*, the side 18 is partially blocked by a removable blocking means 21. The side 17 is completely blocked by a removable blocking means 22.

in all of the figures, the removable blocking means 20, 21, 22 are for example shutters or seals.

Once the removable blocking means 20, 21, 22 have been placed and fixed in position on the edges of the cavities 8, 9, the step of filling the cavity or cavities with gas is carried out.

In the step of filling with gas, each cavity 8, 9 is filled with gas by injecting gas, for example by means of nozzles, via the injection side 19 of the cavity 8, 9. As a variant, the gas may be injected using any porous device. In the rest of the description, for the sake of simplicity, nozzles will be referred to, though this should not be considered as a limitation. In the figures, open nozzles are represented by small arrows 20 pointing upward, whereas closed nozzles are not shown. In the figures, the gas arrives from below the multiple glazing unit. Specifically, the conveyor belt 10 preferably comprises a plurality of through-orifices through which gas is introduced, via the nozzles, into the cavities 8, 9. In the figures, the injection side 19 is opposite the completely closed side 16.

Preferably, the gas is injected at the same time into both cavities 8, 9 located between two adjacent glass sheets, in order to optimize the gas filling time. The cavities 8, 9 are filled until a fill level of gas other than air of at least 80%, and preferably of 85% or more, and even of 90% or more, is reached. Preferably, at least one partially blocked side 17, 18 of each cavity is equipped with a sensor allowing the gas fill level of each cavity to be measured. The sensor is, for example, fixed to the edge of one of the glass sheets, or to the spacer.

The nozzles can preferably move perpendicularly to the glass sheets in order to be able to adapt to multiple glazing units of different sizes, namely glass sheets and/or gas-filled cavities of different thicknesses. In addition, as shown in FIGS. 3 and 4, there are as many rows of nozzles as there are cavities.

The gas injected is preferably a heavy gas, such as argon, krypton or xenon, which provides better thermal insulation than air. Argon is preferred because it is inexpensive.

Preferably, the gas is injected over at least one portion of the length of the injection side 19 of each cavity. In at least part of the gas filling step, some of the nozzles are closed. Thus, the air can easily exit via the partially blocked side or sides 17, 18, thereby allowing the air to be more rapidly expelled.

Gas is injected over a length of between 10 and 100%, preferably of between 30 and 50%, and even a length equal to about a third of the length of the injection side 19 of each cavity. The gas injection length may be located anywhere between the two ends of the injection side 19.

According to the embodiment in FIG. 5, the portion of the injection side 19 over which the gas is injected remains constant throughout the filling step. This portion is preferably located in the middle of the side 19, in particular if the blocking means 20, 21 are symmetrical. The gas injection portion is preferably between 30 and 50%, or even equal to about a third of the length of the injection side 19 of each cavity. Thus, the air escapes via the open portions of the partially blocked sides 17 and 18.

In the embodiment in FIGS. 6*a* to 6*c*, respectively representing the start, an intermediate point, and the end of the filling step, the portion of the injection side 19 over which the gas is injected gradually increases during the filling step, preferably from 10% of the length of the injection side 19 at the start of the step, up to 100% of the length of the injection side 19 at the end of the step. The gas injection portion may also vary between 50% at the start and 100% at the end. Thus, the air escapes via the open portion of the partially blocked side 18.

Preferably, whatever the embodiment, the flow rate of injected gas is proportional to the height of the glazing unit and the thickness of the cavity, and thus to the volume of the cavity. Thus, the flow rate of injected gas per cavity is for example between 100 l/min and 1500 l/min. As a variant, the flow rate of injected gas is not constant throughout the step of filling the cavities with gas, but varies: the flow rate may thus be low at the start of the injection so as to limit turbulence and high at the end of the injection in order to remove any remaining air bubbles.

Before the gas injection, the step of filling the cavities with gas may comprise a step in which the cavities 8, 9 are evacuated. This allows the cavities 8, 9 to be filled more rapidly, once they have been evacuated, but requires an additional step. This also allows excess injected gas to be recovered.

Once the cavities 8, 9 have been filled to at least 80% with a gas other than air, the work station (the same station at which the gas filling was carried out, therefore the second work station for example) briefly presses the glass sheets 1, 2, 3 against one another in order to close the cavities 8, 9 in order to prevent the gas other than air from leaving the cavities 8, 9.

After the step of filling the cavities with gas comes the pressing step. If this step is carried out in a third work station, the conveyor belt 10 may be activated in order to move the glass sheets to the third work station. In the pressing step, the work station presses the glass sheets 1, 2, 3 by exerting a pressure on the external glass sheets 1, 3, preferably perpendicularly to the glazing unit so as to seal the multiple glazing unit.

In the pressing step, the glass sheets 1, 2, 3 are for example all placed vertically. As a variant, the glass sheets 1, 2, 3 are all placed on a plane inclined to the vertical by an angle of between 3° and 10°.

The preassembly step will now be described in greater detail.

In the preassembly step, the glass sheets 1, 2, 3 are fanned out using suckers. In the embodiment in FIGS. 3 to 6, the glass sheet 1 is for example leant against a frame able to move with the conveyor belt 10. As the other glass sheet or sheets 2, 3 are inclined against this glass sheet 1, the sheet or sheets 2, 3 rest on the sheet 1 and have no need of any other support. No means for holding the sheets in place other than the frame is required. However, other means for holding the sheets in place may nevertheless be provided if desired by the user of the process. These other holding means may prove to be useful for positioning which is not done using a frame. One of the glass sheets may be held vertically for example by clips gripping, either both faces of the glass sheet near its edge, or the edge face of the glass sheet at various points on the latter. Other possible means for holding the sheets in position are, for example, suckers or even rollers arranged in a "V" shape in order to hold the glass in position.

These other holding means may for example be used to hold, in a triple glazing unit, the internal glass sheet vertical, the two external glass sheets then being leant against the internal glass sheet, on each side of the latter.

Moreover, the conveyor belt 10 was shown horizontal. However, it may be slightly inclined at an angle of between 3° and 10°.

The fact that it is possible, in the pressing step, to press all the glass sheets of a multiple glazing unit at the same time rather than in two steps, for example when a double glazing unit is first produced, then a triple glazing unit from the double glazing unit, allows:

- on the one hand, less stress to be applied to two of the glass sheets. This is because, in the case of a triple glazing unit manufactured from a double glazing unit, the two glass sheets of the double glazing unit are pressed at the end of the manufacture of the double glazing unit in order to seal the double glazing unit, and then at the end of the manufacture of the triple glazing unit in order to seal the triple glazing unit. Two of the glass sheets are therefore pressed twice. This is avoided in the process according to the invention; and
- on the other hand, the pressure in the two cavities to be made equal. In the case of a triple glazing unit manufactured from a double glazing unit, when the triple glazing unit is pressed, there may be a dissymmetry between the two cavities due to the double pressing of one of the cavities. This may result in a difference in the gas level between the two cavities.

Thus, the multiple glazing unit has a better seal by virtue of the process according to the invention.

After the pressing step, mastic 6, 7 is injected along the spacer or spacers 4, 5 between their face turned toward the exterior of the triple glazing unit and the edge of the glass sheets 1, 2, 3. The mastic seals the multiple glazing unit so that moisture or dust cannot penetrate inside.

In the process according to the invention, before the preassembly step, the process comprises a step of fastening the spacer or spacers 4, 5 to the glass sheet or sheets 1, 2, 3. This step is preferably carried out by adhesive bonding, for example by means of a butyl bead. Preferably the spacer or spacers 4, 5 comprise a desiccant allowing any moisture on the inside of the multiple glazing unit to be absorbed. Also preferably, the spacer or spacers, 4, 5 are thermally isolating ("warm edge").

Thus, for a double glazing unit according to the embodiment in FIG. 1, the spacer 4 may be fastened to face number ② of the glass sheet 1 or to face number ③ of the glass sheet 2. The spacer 4 comprises a first butyl bead for fastening to one of the glass sheets, and a second butyl bead for subsequent fastening to the second glass sheet during the pressing step. Likewise, for a triple glazing unit according to the embodiment shown in FIG. 2, the spacer 4 may be fastened to face number ② of the external glass sheet 1 or to face number ③ of the internal glass sheet 2. Likewise, the spacer 5 may be fastened to face number ⑤ of the external glass sheet 3 or to face number ④ of the internal glass sheet 2. Each of the spacers 4, 5 comprises a first butyl bead for fastening to one of the glass sheets, and a second butyl bead for subsequent fastening to a second glass sheet during the pressing step.

All the butyl beads required to fasten the spacer or spacers 4, 5 to the various surfaces of the glass sheets are deposited before the preassembly step, in order to make the subsequent fastening easier and avoid an intermediate bonding step that would slow the manufacturing process.

The manufacturing process also comprises, before the spacer or spacers are fastened to the glass sheets, a step of cleaning the glass sheets 1, 2, 3. This is because faces ② and ③ of a double glazing unit or ② to ⑤ of a triple glazing unit can no longer be cleaned after the multiple glazing unit has been manufactured since they are on the inside of the glazing unit. Cleaning the glass sheets provides the user of the multiple glazing unit with a better visibility.

Moreover, the glass sheets 1, 2, 3 may be equipped with functional films, such as low-E films (for example on faces numbers ② and ⑤ of a triple glazing unit), antireflection films (for example on faces numbers ③ and ④ of a triple glazing unit), electrochromic stacks, self-cleaning films, anticondensation films, solar control films, etc. A number of functional films may be placed on a given face of the multiple glazing unit.

The process according to the invention has been described for glazing units with four sides, but it also applies to glazing units with a different number of sides, for example triangular glazing units (completely closed at one of their corners in the fanned out position) or even to glazing units with curved upper edges (completely closed at at least one point on their curved edges in the fanned out position).

The invention claimed is:

1. A process for manufacturing a gas-filled multiple glazing unit comprising at least two glass sheets, the process comprising:

preassembling the glass sheets so that the glass sheets are positioned facing one another, at least one of the glass sheets being equipped with a spacer and each glass sheet being positioned inclined at an angle strictly greater than 0° and less than or equal to 10° to the adjacent glass sheet, so as to form at least one cavity, each cavity being located between two adjacent glass sheets and being completely closed on one of its sides;

after said preassembling, partially blocking at least one of the sides of each cavity with a blocking element different from the spacer, said blocking element being positioned against said at least one of the sides so that said blocking element extends over only a first portion of said at least one of the sides to completely block said first portion, a second portion of said at least one of the sides, which is different from the first portion, being unblocked;

after said partially blocking, filling each cavity by injecting gas via an injection side of the cavity to push air present in the cavity to escape via said second portion of said at least one of the sides that is unblocked; and after said filling, pressing the glass sheets against one another in order to seal the multiple glazing unit, wherein said at least one of the sides that is partially blocked is different from the injection side.

2. The process as claimed in claim 1, in which the one or more partially blocked sides are blocked over at least 3% of their length and over at most 90% of their length.

3. The process as claimed in claim 1, in which the one or more partially blocked sides are blocked over a portion starting from one of their ends.

4. The process as claimed in claim 1, in which the gas is injected over at least one portion of a length of the injection side of each cavity.

5. The process as claimed in claim 4, in which the gas injection portion is between 10 and 100% of the length of the injection side of each cavity.

6. The process as claimed in claim 5, in which the gas injection portion is between 30 and 50% of the length of the injection side of each cavity.

7. The process as claimed in claim 6, in which the gas injection portion is a third of the length of the injection side of each cavity.

8. The process as claimed in claim 4, in which two sides of each cavity are partially blocked and in which the gas injection portion is located in the center of the injection side of each cavity, the gas injection portion remaining at a same position relative to the two sides of each cavity that are partially blocked and having a same length throughout the filling.

9. The process as claimed in claim 8, in which the gas injection portion is a third of the length of the injection side of each cavity.

10. The process as claimed in claim 4, in which one side of each cavity is partially blocked, and another side of each cavity is completely blocked.

11. The process as claimed in claim 10, in which the completely blocked side and the injection side are connected to each other so that a corner is formed between the completely blocked side and the injection side, and in which the gas injection portion is located near said corner formed between the completely blocked side and the injection side, the gas injection portion having a length that gradually increases during the filling.

12. The process as claimed in claim 11, in which the length of the gas injection portion gradually increases during the filling up to 100% of the length of the injection side of each cavity.

13. The process as claimed in claim 1, in which the filling comprises measuring the gas fill level of each cavity using a sensor located on the one or more partially blocked sides.

14. The process as claimed in claim 1, in which a flow rate of gas injected into a cavity is proportional to a height of the glazing unit and a thickness of the cavity.

15. The process as claimed in claim 1, in which the glazing unit comprises at least three glass sheets and at least two cavities which are all filled with gas at the same time.

16. The process as claimed in claim 1, in which, in the filling, the gas injected is a heavy gas.

17. The process as claimed in claim 1, in which, in the filling, the gas is injected into the cavities via orifices provided in a belt for conveying the glass sheets.

18. The process as claimed in claim 1, in which the filling comprises evacuating the cavities before the gas is injected.

19. The process as claimed in claim 1, wherein the blocking element is a shutter or a seal.

20. The process as claimed in claim 1, wherein a flow rate of the injected gas varies during said filling.

21. The process as claimed in claim 1, wherein the injected gas is injected into the cavity via a plurality of nozzles and wherein a number of said nozzles that inject the injected gas into the cavity varies during said filling.

22. The process as claimed in claim 1, wherein the second portion of said at least one of the sides has a length that is at least 50% of a length of said at least one of the sides.

23. The process as claimed in claim 1, wherein the first portion has a length of at least 5 cm.

* * * * *